US009993697B2

(12) United States Patent
Cerf

(10) Patent No.: US 9,993,697 B2
(45) Date of Patent: Jun. 12, 2018

(54) SYSTEM FOR BLOCKING STRINGS FOR A RACKET STRINGING MACHINE AND RACKET STRINGING MACHINE COMPRISING SUCH A SYSTEM

(71) Applicant: BABOLAT VS, Lyons (FR)

(72) Inventor: Herve Cerf, Chasse sur Rhone (FR)

(73) Assignee: BABOLAT VS, Lyons (FR)

( * ) Notice: Subject to any disclaimer, the term of this patent is extended or adjusted under 35 U.S.C. 154(b) by 0 days. days.

(21) Appl. No.: 14/920,008

(22) Filed: Oct. 22, 2015

(65) Prior Publication Data

US 2016/0121175 A1 May 5, 2016

(30) Foreign Application Priority Data

Oct. 31, 2014 (FR) ..... 14 60514

(51) Int. Cl.
*A63B 51/14* (2006.01)

(52) U.S. Cl.
CPC ..... *A63B 51/14* (2013.01)

(58) Field of Classification Search
CPC ..... A63B 51/14; A63B 51/00
USPC ..... 473/555, 556; 73/862.43
See application file for complete search history.

(56) References Cited

U.S. PATENT DOCUMENTS 3,823,609 A * 7/1974 Miyagawa ..... A63B 51/14 473/556
3,988,022 A * 10/1976 Halbrook ..... A63B 51/14 473/556
4,376,535 A 3/1983 Muselet et al.
5,080,360 A * 1/1992 Longeat ..... A63B 51/14 473/556
5,090,697 A * 2/1992 Lee ..... A63B 51/14 473/555
6,533,687 B1 3/2003 Lee

FOREIGN PATENT DOCUMENTS

EP 0 034 688 A2 9/1981
EP 0 382 652 A1 8/1990

OTHER PUBLICATIONS

FR Report, dated Jun. 18, 2015, from corresponding FR application.

* cited by examiner

*Primary Examiner* — Gene Kim
*Assistant Examiner* — Christopher Glenn
(74) *Attorney, Agent, or Firm* — Young & Thompson

(57) ABSTRACT

This system (1) for blocking one or more strings (C) of a racket on the stringing machine comprises a guide support on which two clip holders (3) each provided with a clip (37) for gripping a string (C) are mounted. Each of the clip holders (3) is movable relative to the support along a trajectory forming a closed contour around a central axis (X5) of the support.

10 Claims, 4 Drawing Sheets

SYSTEM FOR BLOCKING STRINGS FOR A RACKET STRINGING MACHINE AND RACKET STRINGING MACHINE COMPRISING SUCH A SYSTEM

FIELD OF THE INVENTION

The present invention relates to a system for blocking strings for a racket stringing machine, and a racket stringing machine comprising such a blocking system.

BACKGROUND OF THE INVENTION

In the field of racket sports, such as tennis, badminton or squash, rackets comprise a head made up of interlaced and stretched strings, which must be changed frequently in case of break or loosening. Sporting goods stores and tournament locations therefore have stringing machines including a cradle in which the racket is fixed, a traction system for stretching the strings, and a system for blocking the strings on the head. The blocking system makes it possible to keep the strings stretched on the head during stringing to be able to produce the interlacing of the strings and the final knot without losing the tension of the stringing.

To keep the strings stretched, a blocking system therefore comprises at least one moving clip holder provided with a clip for gripping a string. It is known to equip the blocking system with two moving clip holders on a support, which can define a straight or curved trajectory, making it possible to access different locations of the screen during the stringing of a racket.

It is known to mount each of the clip holders movably on a straight or curved trajectory with limited travel on either side of a central axis of the support. Thus, each clip holder can be moved in a zone corresponding to half of the stringing relative to a longitudinal axis of the racket.

Such systems do not allow total freedom of movement of the clip holders, and do not allow each clip holder to access all of the strings, which may be necessary to string a badminton racket.

The invention aims to resolve these drawbacks by proposing a new system of blocking strings for a racket stringing machine, whereof the movement of the clip holder(s) is less limited relative to the head of the racket than the clip holders of the blocking systems of the prior art.

SUMMARY OF THE INVENTION

To that end, the invention relates to a system for blocking one or more strings of a racket on the stringing machine, comprising a guide support on which two clip holders each provided with a clip for gripping a string are mounted, each of the clip holders being movable relative to the support along a trajectory forming a closed contour around a central axis of the support.

According to the invention, the racket stringer has a blocking system whose usage possibilities are much broader than those of the stringing machines of the prior art. The racket stringer in particular has the option of moving two clip holders on the same side of the head of the racket, which is in particular useful for stringing badminton rackets.

According to advantageous but optional aspects of the invention, such a blocking system may incorporate one or more of the following features, considered in any technically allowable combination:

The support defines an elliptical trajectory.

The support defines a circular trajectory.

The mobility of the clip holders on the guide support is ensured by rollers mounted pivoting on axes of the clip holders so as to cooperate with edges of the guide support.

The rotation of the rollers around their axes is allowed by ball bearings or plain bearings.

The edges of the guide support are beveled, while the clip holders comprise at least two rollers having a beveled groove, on their outer cylindrical surface, each of the rollers respectively rolling on an inner edge and an outer edge of the support.

The support is formed by a flat rail having a homothetic inner edge and outer edge defining the edges of the guide support cooperating with the rollers of the clip holders.

The support is formed by two homothetic flat rails, an outer edge of the rail with a smaller perimeter and an inner edge of the rail with a larger perimeter defining the edges of the guide support cooperating with the rollers of the clip holders.

The clip holders comprise three rollers, including two rollers rolling on the edge of the support with the highest perimeter.

The invention also relates to a stringing machine comprising a blocking system as described above.

BRIEF DESCRIPTION OF THE DRAWINGS

The invention will be better understood, and other advantages thereof will appear more clearly, in light of the following description of a blocking system according to its principle, in reference to the appended drawings, in which.

DETAILED DESCRIPTION OF THE INVENTION

Figure 1:
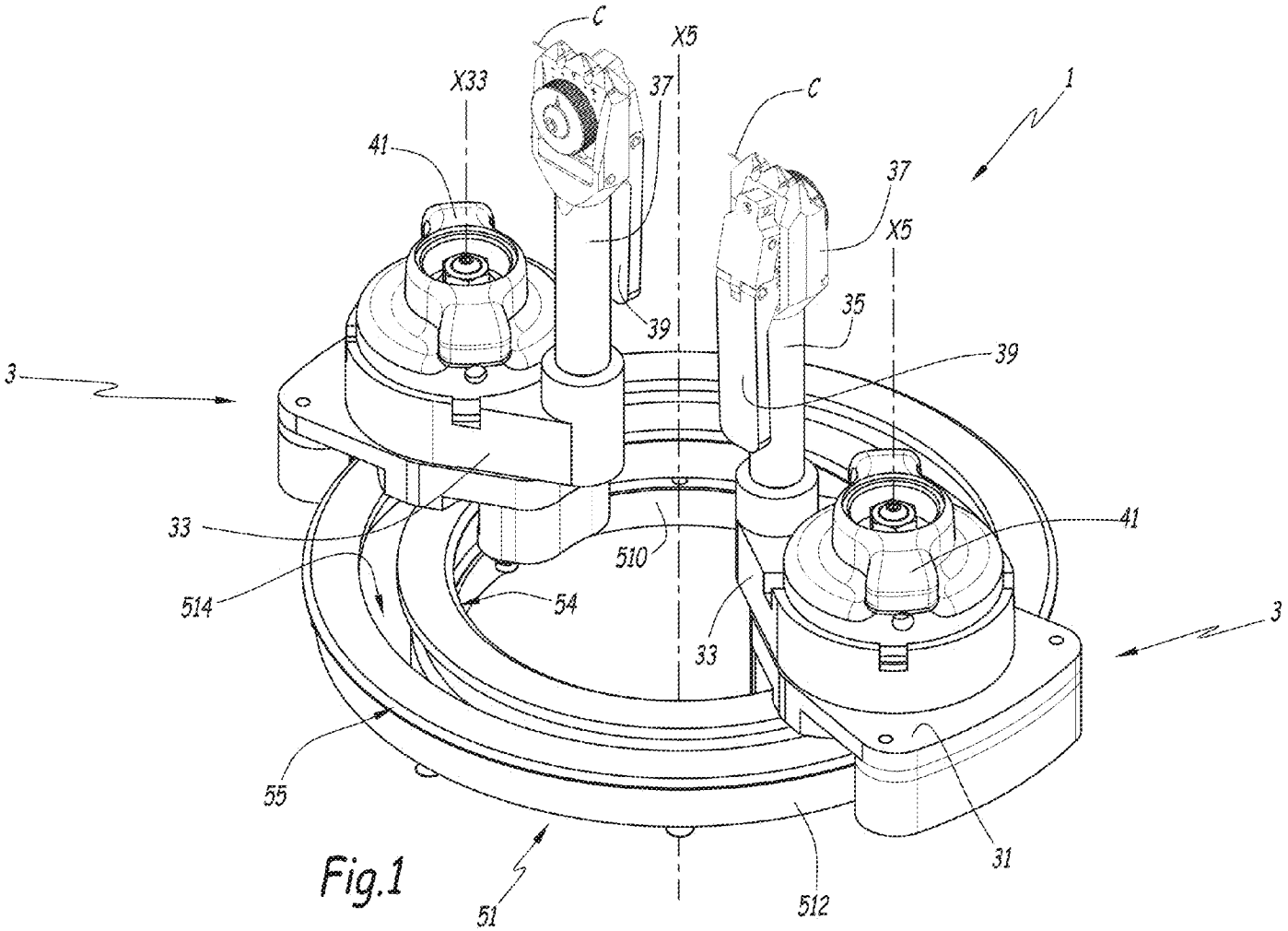
FIG. 1 is a perspective view of a blocking system according to the invention.
Figure 2:
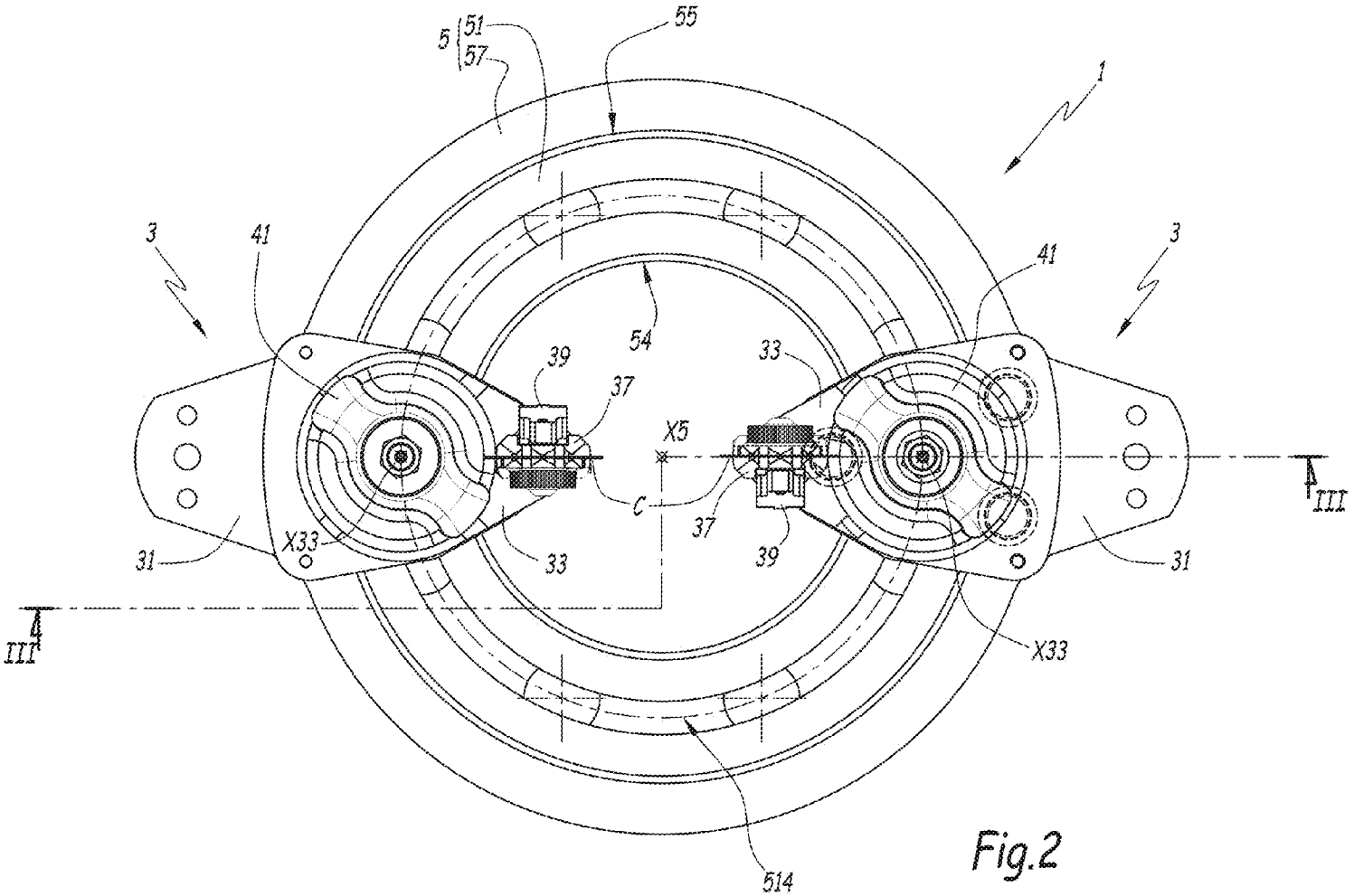
FIG. 2 is a top view of the blocking system of FIG. 1.
Figure 3:
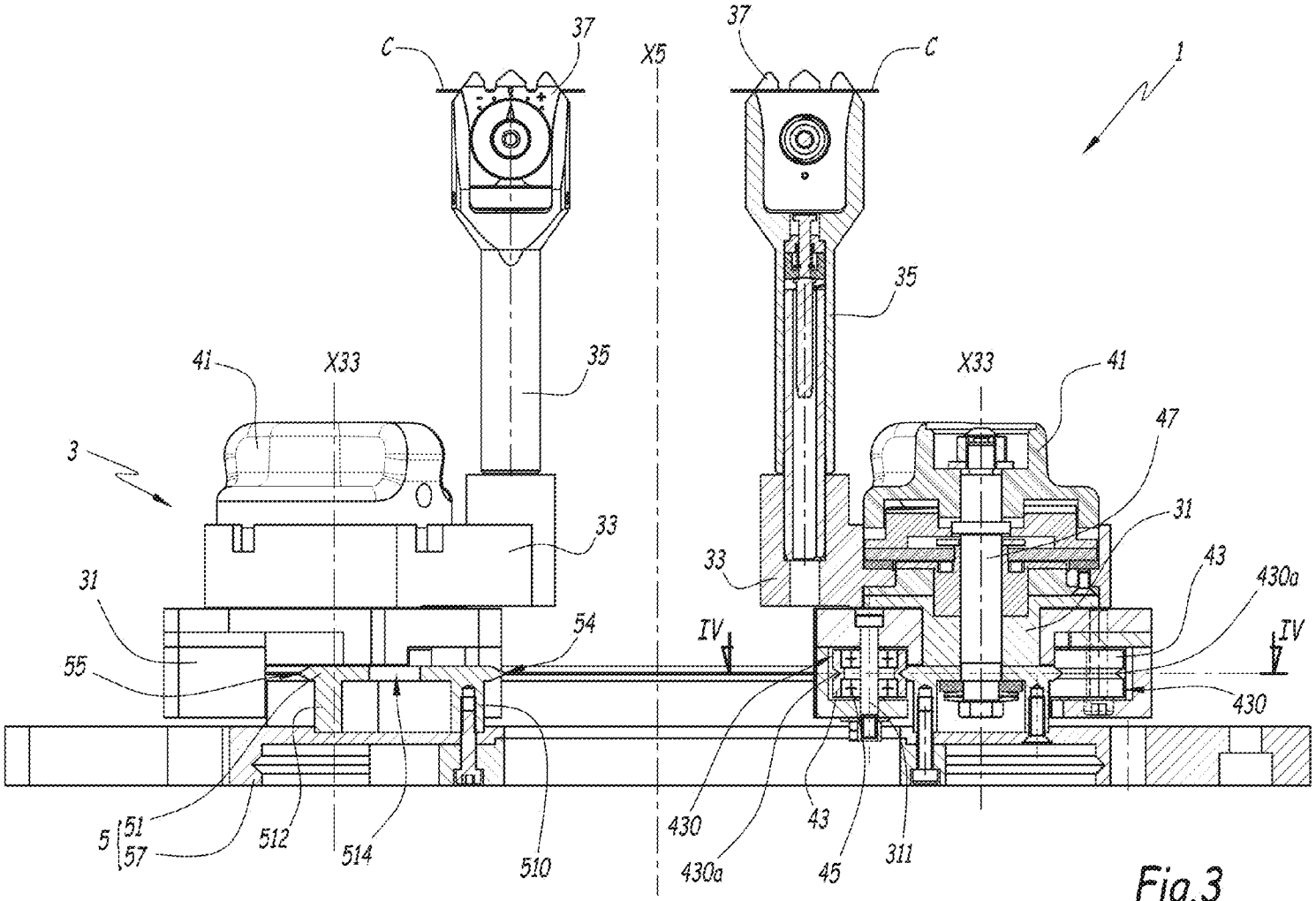
FIG. 3 is a sectional view along line III-III of FIG. 2.
Figure 4:
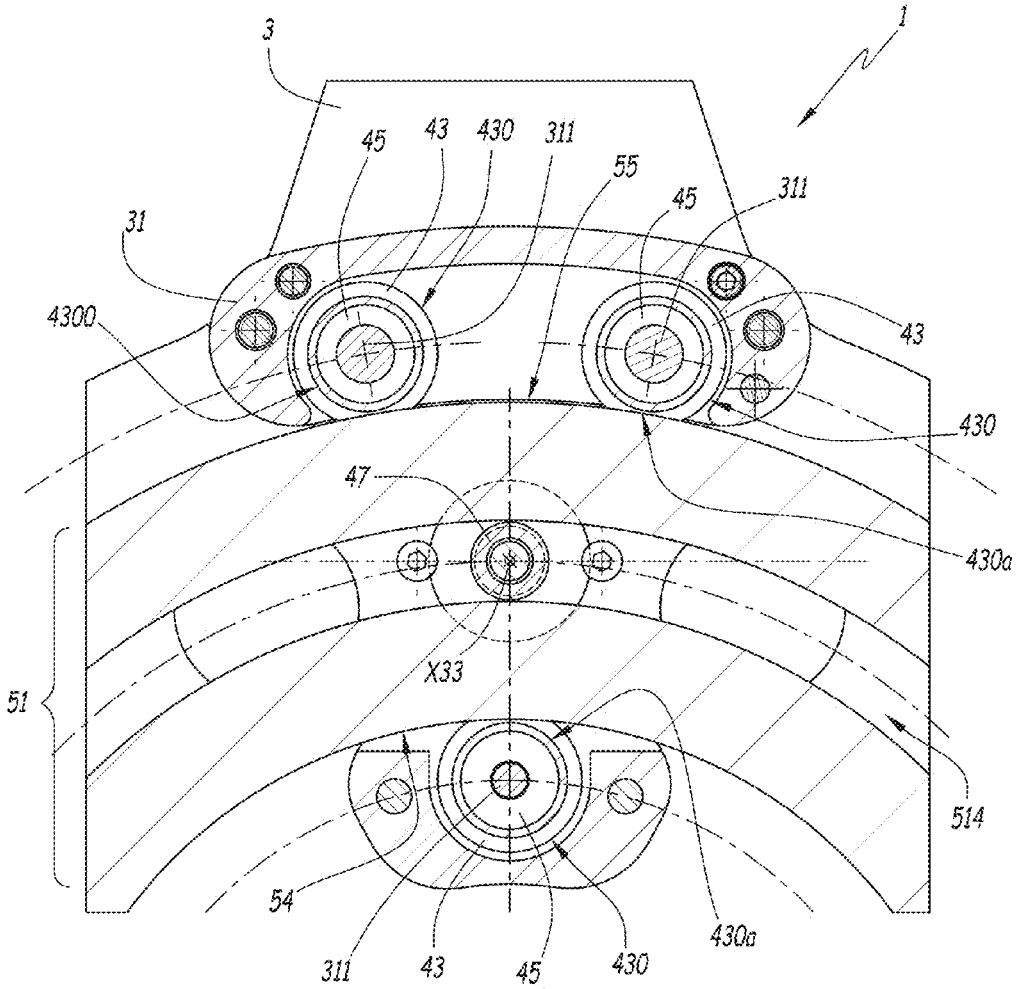
FIG. 4 is a partial sectional view along line IV-IV in FIG. 3.

A blocking system 1 is shown in FIGS. 1 to 4. The blocking system 1 belongs to a stringing machine, not shown. The stringing machine comprises a traction system and a maintaining system for a racket, also not shown. The blocking system 1 is designed to block one or more strings of the racket, during stringing of a racket for racket sports, such as tennis, badminton or squash. Once a string is stretched by the traction system, it is blocked using the blocking system 1 to preserve the tension of the string between the different interweaving operations done during the stringing of a racket.

The blocking system 1 therefore comprises two clip holders 3, each comprising a chassis 31, mounted moving on a guide support 5. Each clip holder 3 includes an arm 33 mounted pivoting along a vertical axis X33 relative to the chassis 31. Each arm 33 comprises, at its end opposite the axis X33, a vertical rod 35 provided with a clip 37 able to grip a string C, partially shown. The clips 37 include jaws able to be gripped against one another using a lever 39 that also makes it possible to lock the clip in the locked position. The rods 35 themselves pivot, relative to the arm 33, along an axis parallel to the axis X33.

Each clip holder 3 includes a manually actuated locking screw 41 making it possible to lock the position of the clip holder 3 on the support 5.

The clip holders 3 are movable along a trajectory forming a closed contour around a central axis X5 of the support 5. This allows significant mobility of the clip holders 3 on the support 5, so as to adapt to all racket and stringing structure scenarios. Stringing a badminton racket in particular requires the placement of two clip holders 3 on a same side of the racket.

In the illustrated example, the support 5 defines a circular trajectory. The guide support 5 is formed by a flat rail 51 with a closed circular shape centered on the axis X5. The rail 51 defines an inner edge 54 of the support 5, situated on the side of the axis X5, and an outer edge 55, situated opposite the axis X5.

On its lower part that extends along the axis X5 opposite the clips 37, the rail 51 comprises two support rings 510 and 512 that extend downward around the axis X5. The rail 51 is fixed in a base 57, visible only in FIGS. 2 and 3, by screws 58 inserted in the support rings 510 and 512. The elements 51 and 57 together make up the guide support 5.

The rail 51 is pierced, at the center of its radial part between the inner 54 and outer 55 edges, with an annular aperture 514 extending over the entire circumference of the rail 51 and which divides the rail into two concentric parts each supported by one of the support rings 510 and 512. This aperture 514 receives a locking system 47 for locking the clip holders 3 in position on the rail 51. The locking system 47 is kinematically connected to the locking screw 41. The locking system 47 makes it possible to grip the rail 51 around the aperture 514 using a brake device.

The mobility of the clip holders 3 relative to the guide support 5 is ensured by rollers 43 mounted pivoting on axes 311 of the chassis 31. In the example, the rotation of the rollers 43 around the axes 311 is allowed by rolling bearings 45. According to one embodiment of the invention that is not illustrated, the rotation of the rollers 43 may be allowed by other types of devices, for example smooth bearings.

The edges 54 and 55 are beveled so as to have, in cross-section, an acute angle between two oblique surfaces that extend from surfaces of the rail 51 perpendicular to the axis X5. The rollers 43 have an outer cylindrical surface 430 comprising a beveled groove 430*a* that cooperates with the beveled edges 54 and 55 of the support 5.

Each clip holder 3 includes at least two rollers 43, a first inner roller 43 rolling on the inner edge 54, and a second outer roller 43 rolling on the outer edge 55. In the illustrated example, each clip holder 3 comprises three rollers 43, two of which roll on the outer edge 55 of the support 5 with the largest perimeter. In an alternative that is not shown, each clip holder 3 may include four rollers 43, two of which roll on each edge 54 and 55.

According to one embodiment that is not shown, the support 5 may comprise two concentric flat annular rails aligned radially such that an outer edge of the rail having the smallest diameter and an inner edge of the rail having the largest diameter are radially across from one another, and form the edges 54 and 55 of the guide support 5. In that case, the clip holder 3 moves between the concentric rails of the guide support 5.

In general, the support 5 defines an elliptical trajectory. In illustrated example, the support 5 is circular, i.e., describes a particular ellipse whereof the focuses are combined. In one embodiment of the invention that is not shown, the support 5 may define a noncircular trajectory.

In that case, the inner edge 54 and the outer edge 55 are homothetic, i.e., they have the same shape, the outer edge 55 having a larger perimeter than that of the inner edge 54. If the support 5 comprises two rails instead of one, those two rails are homothetic.

According to one embodiment of the invention that is not shown, the mobility of the clip holders 3 on the support 5 may be ensured by means other than rollers 43. For example, the clip holder 3 may comprise pads able to slide on the support 5.

The features of the embodiments and alternatives described above may be combined to form new embodiments of the invention.

The invention claimed is:

1. A system for blocking one or more strings of a racket on a racquet stringing machine, the system comprising:

a guide support on which two clip holders each provided with a clip for gripping a string are mounted, wherein each of the clip holders being movable relative to the support along a trajectory forming a closed contour around a central axis of the support, wherein the mobility of the clip holders on the guide support is ensured by rollers mounted pivoting on axes of the clip holders so as to cooperate with edges of the guide support, and wherein the edges of the guide support are beveled, and wherein the clip holders comprise at least two rollers having a beveled groove on their outer cylindrical surface, each of the rollers respectively rolling on an inner edge and an outer edge of the support.

2. The blocking system according to claim 1, wherein the support defines an elliptical trajectory.

3. The blocking system according to claim 2, wherein the support defines a circular trajectory.

4. The blocking system according to claim 1, wherein the rotation of the rollers around their axes is allowed by ball bearings or plain bearings.

5. The blocking system according to claim 1, wherein the support is formed by a flat rail having a homothetic inner edge and outer edge defining the edges of the guide support cooperating with the rollers of the clip holders.

6. The blocking system according to claim 1, wherein the support defines a closed trajectory, the support being formed by a flat rail with a closed shape, the flat rail defining an inner edge of the support and an opposite outer edge of the support, the inner edge having a smaller perimeter than the outer edge.

7. The blocking system according to claim 1, wherein the clip holders comprise three rollers, including two rollers rolling on the edge of the support with the highest perimeter.

8. The blocking system according to claim 1, in combination with the racket stringing machine.

9. A system for blocking one or more strings of a racket on a racquet stringing machine, the system comprising:

a guide support (5) with a central axis (X5), the guide support defining a closed trajectory around the central axis, the closed trajectory including a beveled inner edge and an opposite beveled outer edge, the inner edge having a smaller perimeter than the outer edge;

two clip holders (3) for gripping a string, each clip holder comprising a chassis (31) movably mounted on the guide support (5) along the closed trajectory, each chassis (31) having a vertical axis (X33), each clip holder (3) further comprising an arm (33) mounted pivoting along the vertical axis (X33) of the chassis (31), the arm (33) comprising at an end opposite the vertical axis (X33), a vertical rod (35) provided with a clip (37) able to grip the string, the vertical rod (35) of each clip holder (3) pivotable relative to the arm (33) along an axis parallel to the vertical axis (X33); and at least two rollers (43) mounted pivoting on axes of each clip holder (3), each of the at least two rollers (43) having an outer cylindrical surface (430) comprising a beveled groove (430*a*) that cooperates with the beveled inner and outer edges of the guide support, wherein mobility of the clip holders (3) on the guide support is ensured by the at least two rollers being mounted pivoting on the axes (311) of the clip holders so as to cooperate with the beveled inner and outer edges of the closed trajectory of the guide support.

10. The blocking system of claim 9, wherein, each clip holder (3) further comprises a lever (39) operable to lock the clip (37) in a locked position, and each clip (37) includes jaws able to be gripped against one another using the lever (39).

* * * * *